US005979332A

United States Patent [19]

Hammer et al.

[11] Patent Number: 5,979,332

[45] Date of Patent: Nov. 9, 1999

[54] FRAGMENTATION BODY FOR A FRAGMENTATION PROJECTILE

[75] Inventors: Helmut Hammer, Heroldsberg; Rainer Himmert, Lauf; Gerald Rieger; Erich Bock, both of Nuremberg, all of Germany

[73] Assignee: Diehl Stiftung & Co., Nürnberg, Germany

[21] Appl. No.: 09/050,458

[22] Filed: Mar. 30, 1998

[30] Foreign Application Priority Data

Apr. 23, 1997 [DE] Germany ..... 197 17 088

[51] Int. Cl.[6] ..... F42B 12/32

[52] U.S. Cl. ..... 102/496; 389/482

[58] Field of Search ..... 102/389, 473, 102/482, 491–497, 499, 506

[56] References Cited

U.S. PATENT DOCUMENTS

| | | | |
|---|---|---|---|
| 2,933,799 | 4/1960 | Semon | 102/493 |
| 3,855,933 | 12/1974 | Messineo . | |
| 4,398,467 | 8/1983 | Leigh | 102/389 |
| 4,524,696 | 6/1985 | Altenau et al. | 102/473 |
| 4,817,532 | 4/1989 | Assmann | 102/482 |
| 4,974,516 | 12/1990 | Eyal et al. . | |
| 5,594,197 | 1/1997 | Lindstadt et al. | 102/473 |

FOREIGN PATENT DOCUMENTS

| | | | |
|---|---|---|---|
| 108741 | 5/1984 | European Pat. Off. | 102/491 |
| 2205074 | 3/1977 | Germany . | |
| 3401513 C2 | 7/1985 | Germany . | |
| 0180734 | 5/1986 | Germany . | |
| 90 17347 U | 5/1992 | Germany . | |
| 1142716 | 12/1969 | United Kingdom | 102/493 |

*Primary Examiner*—Harold J. Tudor
*Attorney, Agent, or Firm*—Scully, Scott, Murphy & Presser

[57] ABSTRACT

In an infantry grenade (5) the fragmentation effect is enhanced in that a cup portion (7) of a ductile steel—which serves to receive an explosive charge (9)—has at its periphery in a substantially cylindrical longitudinal portion (25) a pre-notched fragmentation arrangement (28, 29) and in a rounded longitudinal portion (26) ball-type fragmentation portions (32). The entire fragmentation arrangement is enclosed by a plastic shell (17).

9 Claims, 1 Drawing Sheet

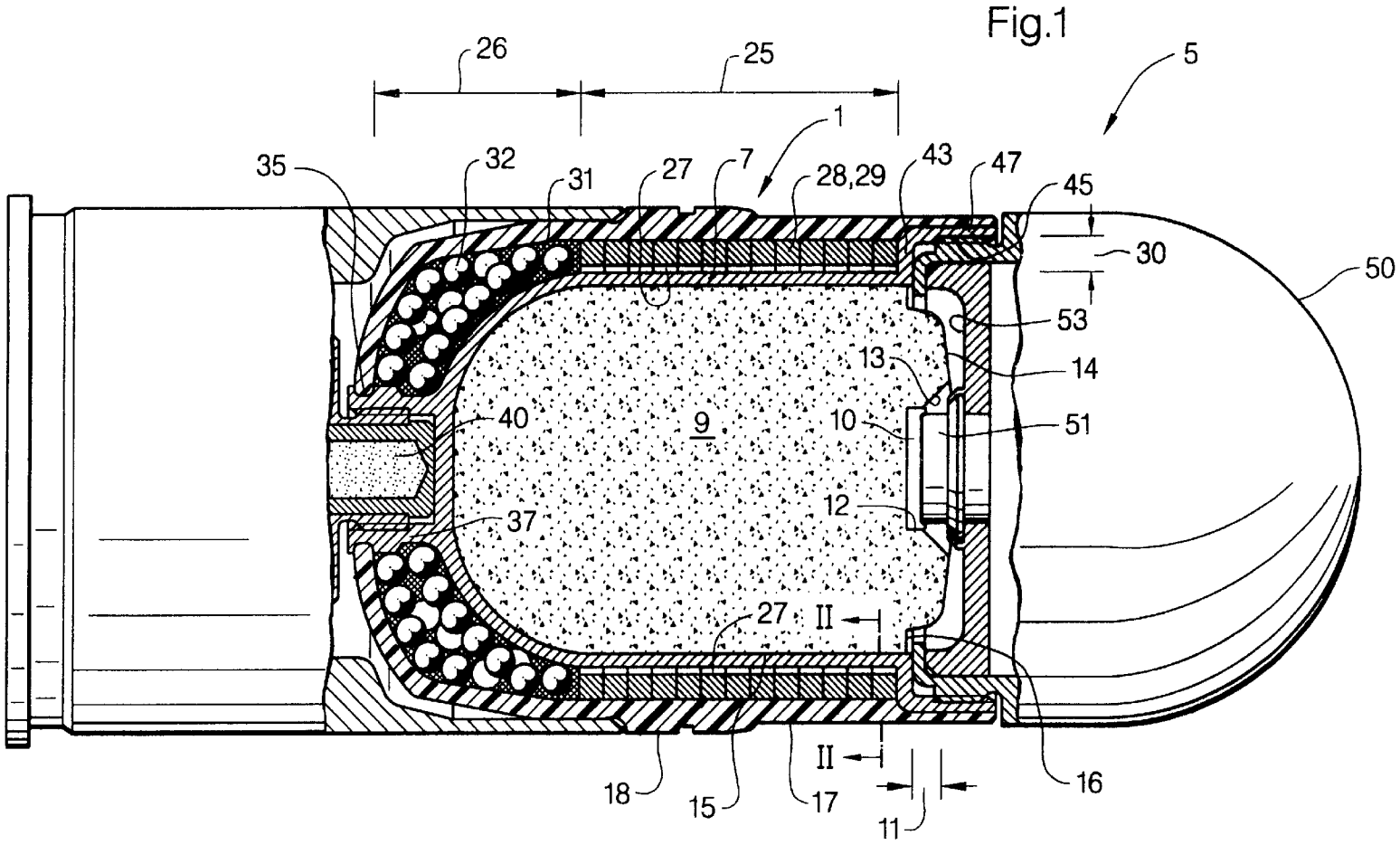
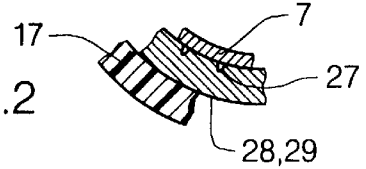
Fig.2

FRAGMENTATION BODY FOR A FRAGMENTATION PROJECTILE

BACKGROUND OF THE INVENTION

1. Field of the Invention

The invention relates to a fragmentation body for a fragmentation projectile which includes a cup portion made of metal for receiving an explosive charge. At the opening of the cup portion there is provide a redial should as an abutment for the fragmentation body, with the fragmentation body enclosing the cup portion about its periphery and also substantially at the tail end thereof. A plastic shell encloses both the fragmentation body and the radial shoulder with an adjoining cylindrical flange.

2. Discussion of the Prior Art

German utility model No 90 17 347 discloses a fragmentation projectile having a fragmentation casing of plastic material. The fragmentation body comprises a cup portion made of metal for receiving an explosive charge, wherein provided at the opening thereof is a radial shoulder as an abutment for the fragmentation body. At its periphery the cup portions is surrounded by the fragmentation body. The fragmentation body has ball-type fragmentation portions which are bound in plastic material. A plastic shell surrounds the fragmentation body and a radial shoulder of the cup portion with a cylindrical flange arranged thereon at its opening.

SUMMARY OF THE INVENTION

The object of the present invention is that of providing a fragmentation body which has a greater fragmentation effect.

The invention attains the foregoing object in that the fragmentation body is divided into two longitudinal portions, insofar as a pre-notched fragmentation arrangement is provided at the periphery of the cup portion, and ball-type fragmentation portion are provided in a rounded tail part of the cup portion. The cup portion comprises a ductile material which, at the opening of the cup portion, has a cylindrical flange for connection to a fuze, and the explosive charge extends beyond the shoulder into the flange, whereby the explosive charge projects with a projection length into an opening in the fuze.

BRIEF DESCRIPTION OF THE DRAWINGS

An embodiment of the invention is illustrated in the drawing in which:

FIG. 1 is a view in longitudinal section of a fragmentation body as a component of an infantry grenade, and FIG. 2 is a view in section taken along line II—II in FIG. 1.

DETAILED DESCRIPTION OF A PREFERRED EMBODIMENT

A fragmentation body 1 of an infantry grenade 5, which is shown in longitudinal section, comprises a cup portion 7 of a ductile steel, an explosive charge 9 arranged therein, and a plastic shell 17 with a guide ring 18 formed thereon.

The fragmentation body 1 is divided into two longitudinal portions 25, 26.

The front portion 25, which is towards the opening, comprises fragmentation rings 28 provided at the inside with notches 27, or turns or coils 29 provided with notches 27, the rings or turns or coils each comprising steel.

Provided in the longitudinal portion 26 are ball-type fragmentation portions 32 which are disposed in plastic material 31.

At the tail end the plastic shell 17 is disposed in an annular groove 35 in a tubular projection 37 on the cup portion 7. The tubular projection 37 supports a tracer bullet 40. The cup portion 7 further has at its open end a radial shoulder 43 as an abutment for the fragmentation body 1 and a thin-wall flange 47 provided with a screwthread 45. A fuse 50 is screwed into the screwthread 45 and bears axially against the shoulder 43.

The explosive 9 extends beyond the radial shoulder 43 by a distance corresponding to a projection length as indicated at 11, into the region of the flange 47. In that arrangement the explosive 9 has a central bore 10 at its end, into which projects a detonator booster 51 of the fuse 50.

The pre-notched fragmentation rings 28 or the pre-notched turns are of a small radial height 30 so that on the one hand fragmentation portions which are effective in a radial direction can be produced, while on the other hand the small height 30 of the fragmentation rings 28 or turns 29 in the radial direction makes it possible to afford a large volume for the explosive 9.

The ball-type fragmentation portions 32 are arranged in a multi-layer configuration in the longitudinal direction 26 as there is a larger amount of space available here.

The plastic shell 17 encloses the entire fragmentation body 1, from the front end of the flange 47, and contributes substantially to the strength of the infantry grenade 5, in terms of firing thereof.

After the explosive charge 9 has been fired—starting from the detonator booster 51—the cup portion 7 is broken into fragments—in a manner corresponding to the geometrical distribution of the notches 27 of the fragmentation rings 28 or the turns 29 and the position of the ball-type fragmentation portions 32—in accordance with a pattern which is predetermined thereby—and accelerated in a radial direction and at the tail end, together with the individual fragmentation portions (not shown) from the fragmentation rings 28 or 29 and the ball-type fragmentation portions 32. The ball-type fragmentation portions 32 and the notches 27 of the fragmentation rings 28 or the turns 29 produce pre-fragmentation of the cup portion 7.

The fuse 50 is also broken into fragments as here the explosive charge 9 projects on the one hand into an opening 53 in the fuse 50 and on the other hand the explosive charge 9 surrounds the detonator booster 51.

The bore 10 with its short cylindrical portion 12 and the conically open portion 13, together with the ring 14 at the end of the explosive, cause reproducible destruction of the fuse 50. That ring 14 has a free shoulder 16, relative to the periphery 15 of the explosive charge 9. The ring 14, in conjunction with the conical portion 13, possibly produces a directional explosive action for destroying the fuse 50.

The fragmentation effect is therefore composed of four components, more specifically the steel fragments of the cup portion 7, the ball-type fragmentation portions 32, the steel fragments of the fragmentation rings 28 or the turns 29 and the fragments of the fuse 50.

We claim:

1. A fragmentation projectile comprising a fragmentation body, a metal cup portion having an explosive charge arranged therein, said cup portion having an opening provided with a radial shoulder forming an abutment for said fragmentation body, said fragmentation body encompassing a peripheral section of the cup portion and substantially a rounded tail part of said cup portion; a plastic shell encompassing the fragmentation body and encompassing the radial shoulder with an adjoining cylindrical flange, said fragmentation body (1) being divided into two contiguous longitudinal portions (25, 26); a pre-notched metal fragmentation arrangement (28, 29) extending about the peripheral section of the cup portion (7), and ball-shaped fragmentation portions (32) being arranged about the rounded tail part of said cup portion (7), said cup portion (7) having a cylindrical flange (47) at the opening, a fuse (50) being connected to said cylindrical flange, the explosive (9) extending beyond the shoulder (43) into the flange (47), and the explosive charge (9) having a projecting length (11) extending into an opening (53) formed in the fuse (50), whereby detonation of said projectile generates a fragmentation effect from four components consisting, respectively, of fragments produced from said cup portion, fragments produced from said ball-shaped fragmentation portions, fragments produced from said pre-notched metal fragmentation arrangement, and fragments produced through a fragmentation of said fuse.

2. A fragmentation projectile according to claim 1, wherein said pre-notched metal fragmentation arrangement selectively comprises individual fragmentation rings (28) or coil turns (29).

3. A fragmentation projectile according to claim 2, wherein said pre-notched metal fragmentation arrangement is constituted of steel.

4. A fragmentation projectile according to claim 2, wherein the pre-notched fragmentation arrangement (28, 29) and the ball-shaped fragmentation portions (32) are arranged in at least one layer about said cup portion.

5. A fragmentation projectile according to claim 4, wherein said ball-shaped fragmentation portions (32) are arranged in a plurality of layers about the rounded tail part of said cup portion.

6. A fragmentation projectile according to claim 5, wherein said ball-shaped fragmentation portions (32) are constituted of metal and are disposed within a plastic material.

7. A fragmentation projectile according to claim 1, wherein said explosive charge (9) is contacted by a ring (14) at an end distant from the rounded tail part of the cup portion which extends into an opening (53) formed in a bottom of the fuse (50).

8. A fragmentation projectile according to claim 7, wherein said end of the explosive charge (9) possesses a central bore (10) with a conical wall portion (13) extending thereabout.

9. A fragmentation projectile according to claim 1, wherein said fragmentation body is constituted of a ductile steel.

* * * * *